US010636535B2

(12) United States Patent
Wickland et al.

(10) Patent No.: US 10,636,535 B2
(45) Date of Patent: Apr. 28, 2020

(54) STORAGE CONTAINERS

(71) Applicant: NUCLEAR FILTER TECHNOLOGY, INC., Golden, CO (US)

(72) Inventors: Terry J. Wickland, Evergreen, CO (US); Darold M. Popish, Golden, CO (US); Michael D. Peterson, Parker, CO (US); Luke Anderson, Arvada, CO (US)

(73) Assignee: NUCLEAR FILTER TECHNOLOGY, INC., Golden, CO (US)

( * ) Notice: Subject to any disclaimer, the term of this patent is extended or adjusted under 35 U.S.C. 154(b) by 386 days.

(21) Appl. No.: 15/276,422

(22) Filed: Sep. 26, 2016

(65) Prior Publication Data

US 2017/0092383 A1 Mar. 30, 2017

Related U.S. Application Data

(63) Continuation of application No. 11/705,028, filed on Feb. 12, 2007, now abandoned.

(60) Provisional application No. 60/772,542, filed on Feb. 13, 2006.

(51) Int. Cl.

| | |
|---|---|
| ***G21F 5/005*** | (2006.01) |
| ***B65B 7/28*** | (2006.01) |
| ***B65D 51/14*** | (2006.01) |
| ***G21F 5/12*** | (2006.01) |

(52) U.S. Cl.

CPC ..... *G21F 5/005* (2013.01); *B65B 7/2842* (2013.01); *B65D 51/145* (2013.01); *G21F 5/12* (2013.01)

(58) Field of Classification Search

CPC ..... G21F 5/005; G21F 5/12; B65B 7/2842; B65D 51/145

See application file for complete search history.

(56) References Cited

U.S. PATENT DOCUMENTS

| | | | |
|---|---|---|---|
| 1,965,273 | A | 7/1934 | Wilson |
| 2,646,808 | A | 7/1953 | Yenne |
| 2,750,067 | A | 6/1956 | Wiggins |
| 4,203,686 | A | 5/1980 | Bowman |
| 4,435,195 | A | 3/1984 | Testone |
| 4,474,303 | A | 10/1984 | Maccise |
| 5,725,645 | A | 3/1998 | Wickland et al. |
| 5,727,707 | A | 3/1998 | Wickland et al. |
| 5,814,118 | A | 9/1998 | Wickland et al. |
| 5,911,332 | A | 6/1999 | Wickland et al. |
| 5,947,318 | A | 9/1999 | Palm |
| 6,355,078 | B1 | 3/2002 | Wickland |
| 6,395,050 | B1 | 5/2002 | Wickland et al. |

(Continued)

*Primary Examiner* — Andrew T Kirsch

(74) *Attorney, Agent, or Firm* — Millen, White, Zelano & Branigan, PC; Ryan Pool

(57) ABSTRACT

Filtered storage containers for hazardous waste, such as radioactive waste, more particularly plutonium in the form of oxides and salts, are made of stainless steel and include lids which are retained by retaining rings that utilize bayonet or ratchet closures that cooperate with rims that are integral with cans to hold the lids in place. Sealing arrangements are provided that each include an O-ring of a circular cross section which seals radially between the lid and rim, as well as a seal of cruciform cross section, which seal provides compression sealing between the lid and an annular shelf within the rim upon locking the retaining ring to the rim with the bayonet or ratchet fitting.

32 Claims, 12 Drawing Sheets

(56) References Cited

U.S. PATENT DOCUMENTS

| | | | |
|---|---|---|---|
| 6,413,304 | B1 | 7/2002 | Wickland et al. |
| 6,557,428 | B2 | 5/2003 | Wickland et al. |
| 6,830,683 | B2 | 12/2004 | Gundrum et al. |
| 6,911,061 | B2 | 6/2005 | Peterson et al. |
| 6,935,199 | B2 | 8/2005 | Wickland et al. |
| 6,948,391 | B2 | 9/2005 | Brassell et al. |
| 7,048,139 | B1 | 5/2006 | Peterson et al. |
| 2006/0196891 | A1 | 9/2006 | Gerson et al. |
| 2007/0246375 | A1 | 10/2007 | Wickland et al. |
| 2007/0290149 | A1 | 12/2007 | Wickland et al. |

STORAGE CONTAINERS

The entire disclosures of all applications, patents and publications, cited herein and of corresponding U.S. application Ser. No. 11/705,028, filed Feb. 12, 2007, and U.S. Provisional Application Ser. No. 60/772,542, filed Feb. 13, 2006, are incorporated by reference herein.

FIELD OF THE INVENTION

The present invention relates to storage containers. More particularly, the present invention relates to storage containers especially useful for storing radioactive materials, such as plutonium in the form of oxides and salts, as well as in other forms.

BACKGROUND OF THE INVENTION

Plutonium is a man-made radioactive element which is used as an explosive ingredient in nuclear weapons and as a fuel for nuclear reactors. It has the important nuclear property of being readily fissionable with neutrons and is available in relatively large quantities. Caution must be exercised in handling plutonium to avoid unintentional formation of critical mass. Plutonium in liquid solutions is more apt to become critical than solid plutonium so it is also very important to avoid the unintentional creation of a liquid solution. Since plutonium is considered to be highly carcinogenic, it is important that plutonium in any form be contained and not escape into the surrounding environment where it can be inhaled or otherwise ingested by humans or other living things. Frequently, plutonium oxides and salts are in the form of powders which require very special handling to ensure that particles do not become suspended in the air and that liquid does not come into contact with the powders. Optionally, such containers are vented through high efficiency particulate filters.

SUMMARY OF THE INVENTION

In view of the aforementioned considerations, it is a feature of the present invention to provide new and improved canisters for storage of hazardous materials such as radioactive materials.

In view of this feature, the container for hazardous materials comprises a can having a closed end and an open end with a locking rim located at the opened end. The locking rim has a shelf therein of a first inner diameter and locking lugs with spaces therebetween disposed in spaced relation to the shelf. A lid having an outer surface and an inner surface is supported on the shelf of the can wherein the outer surface of the lid has a diameter larger than the inner diameter of the shelf. A gasket is disposed between the shelf and the inner surface of the lid and a retaining ring for locking the lid to the gasket has a connection thereon which cooperates with the container to hold the lid in place.

In a further aspect of the container, the container has a handle mounted on the retaining ring.

In still a further aspect of the container, the handle is pivoted on the retaining ring to fold toward the lid.

In still a further aspect of the container, a cavity is defined above the lid by the retaining ring with the handle being U-shaped and pivoted to the retaining ring by pintles which extend into holes in the retaining ring to dispose the handle within the cavity when the handle is folded toward the lid.

In still a further aspect of the container, the retaining ring has laterally opening drains extending therein to drain liquid from the lid.

In a further aspect of the container, the container is made of stainless steel having high heat conductivity which can withstand temperatures to about 450° F.

In still a further aspect of the container, the hazardous waste contained thereby is transuranic material.

In further aspects of the container, the container includes a gas vent therethrough having a particle filter therein.

In still a further aspect of the container, the container includes a sampling port containing a one-way valve allowing insertion of a probe through the port to sample fluids within the container.

In still another aspect of the container, the container is in combination with similar containers of differing heights, widths and volumes with the container being receivable within another container and or receiving another container therein to nest a series of similar containers.

In still another aspect of the container, the locking ring has a bayonet connection to the can; and In still another aspect of the container, the locking ring has a ratchet connection with the can.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
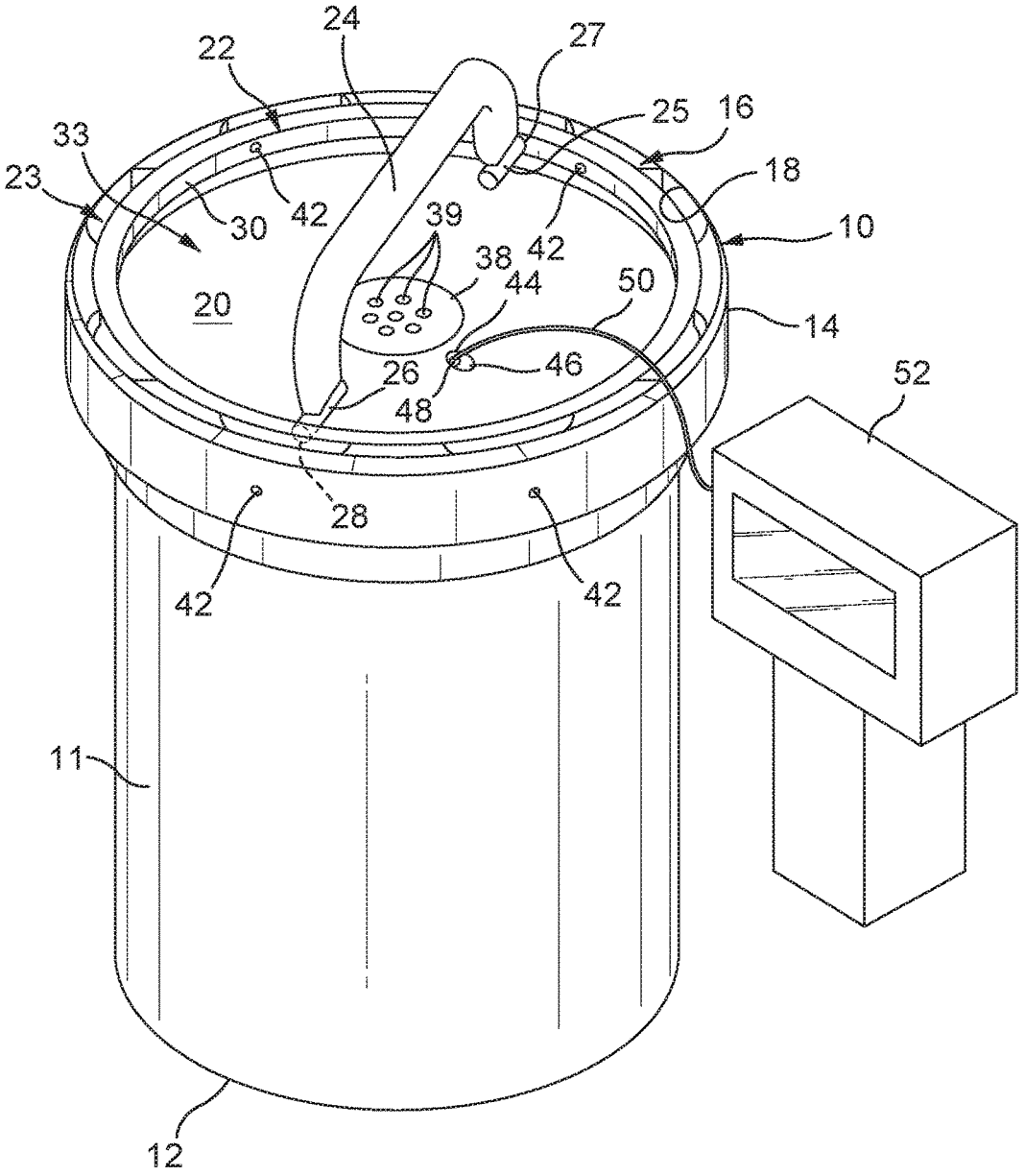
FIG. 1 is a perspective view of a storage container configured in accordance with a first embodiment of the storage container.

Referring now to FIG. 1 there is shown a container 10 comprising a can 11 which has a closed end 12 and an open end 14 defining a mouth 15 of the container. The open end 14 has a locking rim 16 with an inner wall 18 and a lid 20 positioned and supported on a shelf 21 on the inner wall. A retaining ring 22 has a bayonet coupling 23 with the inner wall 18 of the rim 16 to retain the lid 20 in place at the open end 14 of the can 11. A handle 24 is pivoted on the retaining ring 22 by a pair of pintles 25 and 26 positioned in holes 27 and 28 in an inwardly facing wall 30 of the retaining ring 22. The retaining ring 22 defines a cavity 33 in to which the handle 24 pivots facilitating stacking of the container 10.

In accordance with one aspect of the invention, the container 10 optionally has a vent 38 therein with openings 39 therein which exhaust gases and vapors which have been filtered by a particulate filter such as the filter described in U.S. Pat. No. 5,727,707, incorporated in its entirety herein by reference. The retaining ring 22 and the rim 16 have drain openings 42 therethrough which allow liquids, such as water, to flow from the lid 20 so as to not accumulate over the vent 38 and possibly over time compromise the filter element within the vent. The filter is preferably a carbon-carbon or stainless steel low profile filter which is assembled with a membrane of a material such as GORTEX® so as to exclude water thereby providing a filter which resists both corrosion and mechanical impacts to the container 10. In another embodiment of the invention, the can is hermetically sealed without a vent, such as the vent 38.

The lid 20 preferably includes a port 44 extending therethrough. The port 44 is sealed by a one-way valve 46 through which a probe 48 is inserted. The probe 48 is attached by a line 50 to a monitor 52 which detects the presence of hydrogen or other explosive gases within the container 10.

Figure 2:
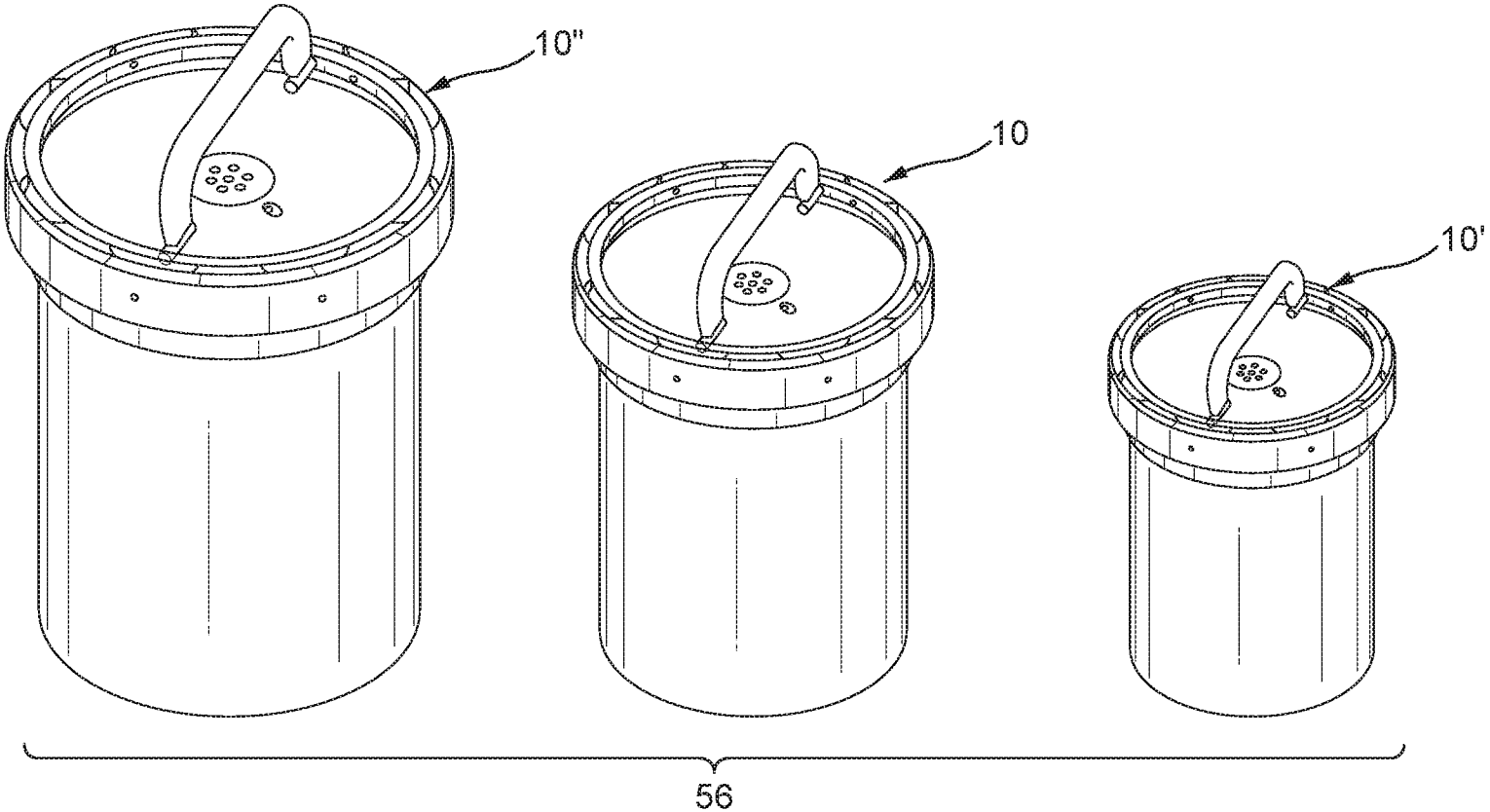
FIG. 2 is a view of three storage containers each having substantially the same configuration as the storage containers in FIG. 1, but being of different sizes.

Referring now to FIG. 2 there are shown three containers 10, 10' and 10", the container 10' being smaller than the container 10 and the container 10" being larger than the container 10. The containers 10, 10' and 10" have substantially the same shape and configuration but are different sizes and may range from about 1 liter to about 70 liters in volume. The containers 10, 10' and 10" exemplify a set 56 of the containers.

Figure 3:
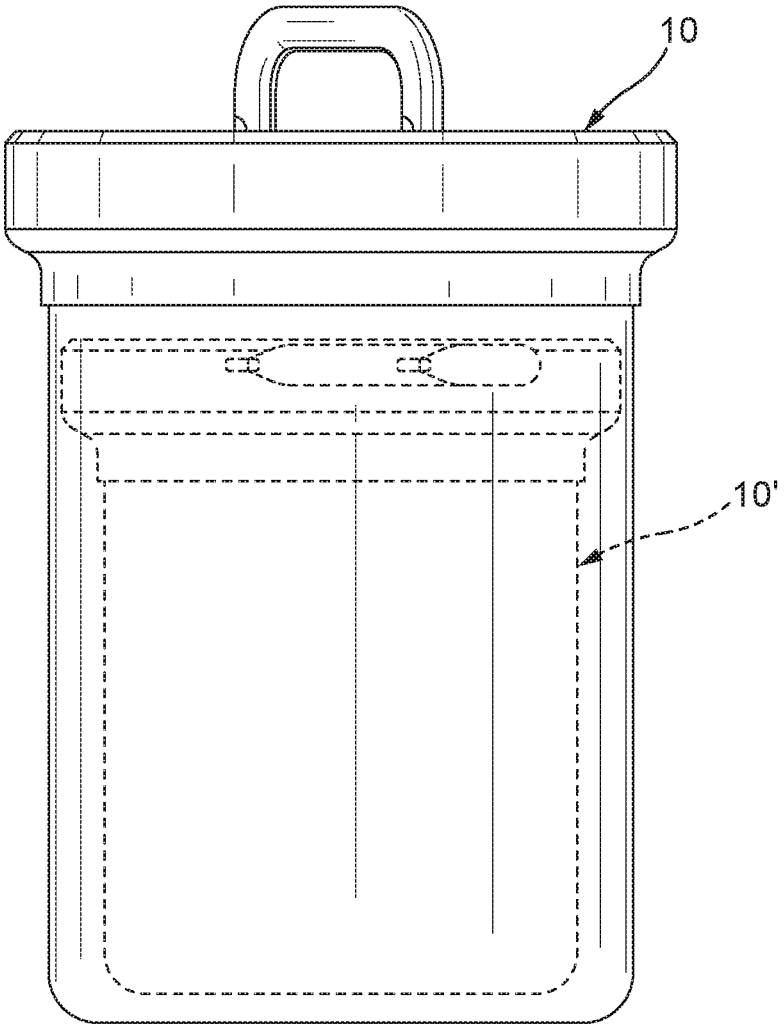
FIG. 3 is a side elevation of two storage containers of FIG. 2 with one container stored within the other.

Referring now to FIG. 3, two containers 10 and 10' are shown with the container 10' nested completely within the container 10, thus saving considerable storage space prior to using the containers. While nesting of two containers 10 and 10' is shown, the number of containers may be increased with perhaps the only restraint being the weight of the nested containers and perhaps the accessibility of smaller containers.

Figure 4:
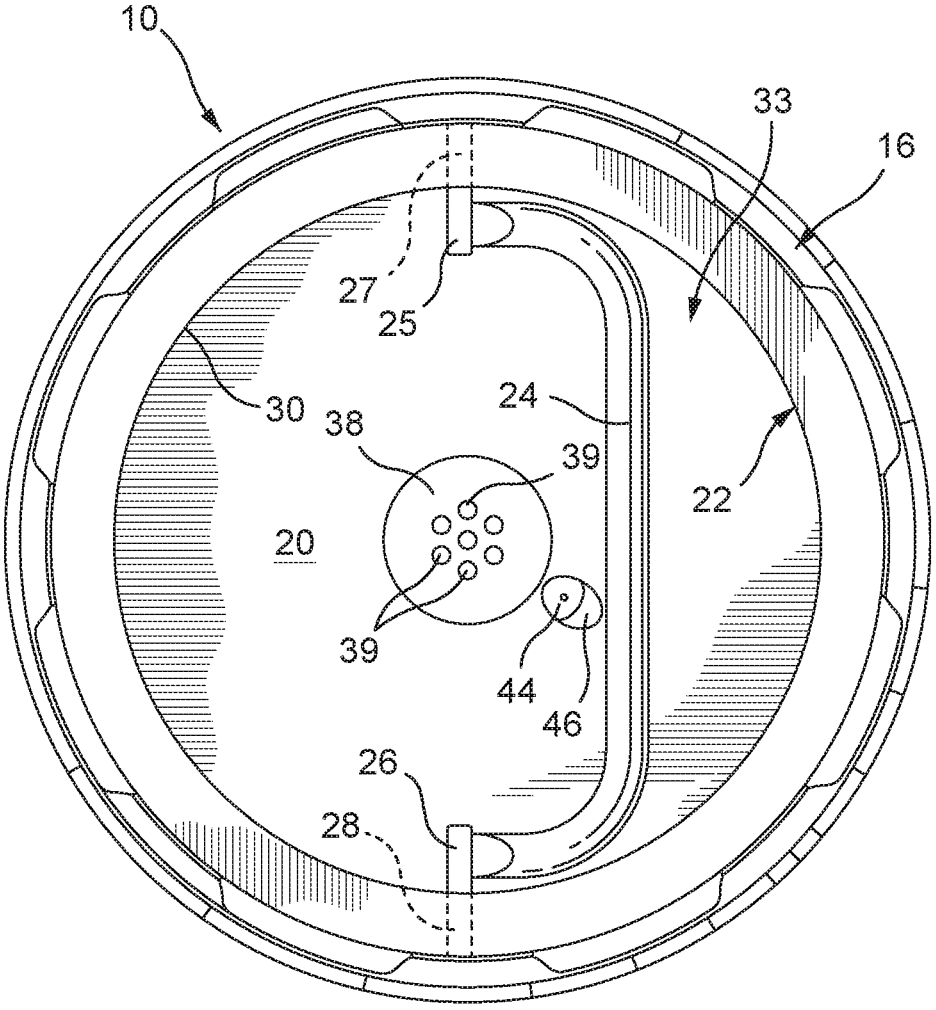
FIG. 4 is a top view of one of the storage container of FIGS. 1-3.

Referring now to FIG. 4 there is shown a top view of a container 10 configured in accordance with the containers of FIGS. 1-3 but showing the handle 24 pivoted to the folded position in which the handle is completely disposed within the cavity 33 so as to not project above the rim 16 of retaining ring 22. By mounting the handles 24 to pivot, the containers 10 can be stacked without interference from the handles which conserves considerable vertical space. Moreover, since the handles are totally within the lateral confines of the container 10, lateral interference is also avoided increasing lateral storage space.

Figure 5:
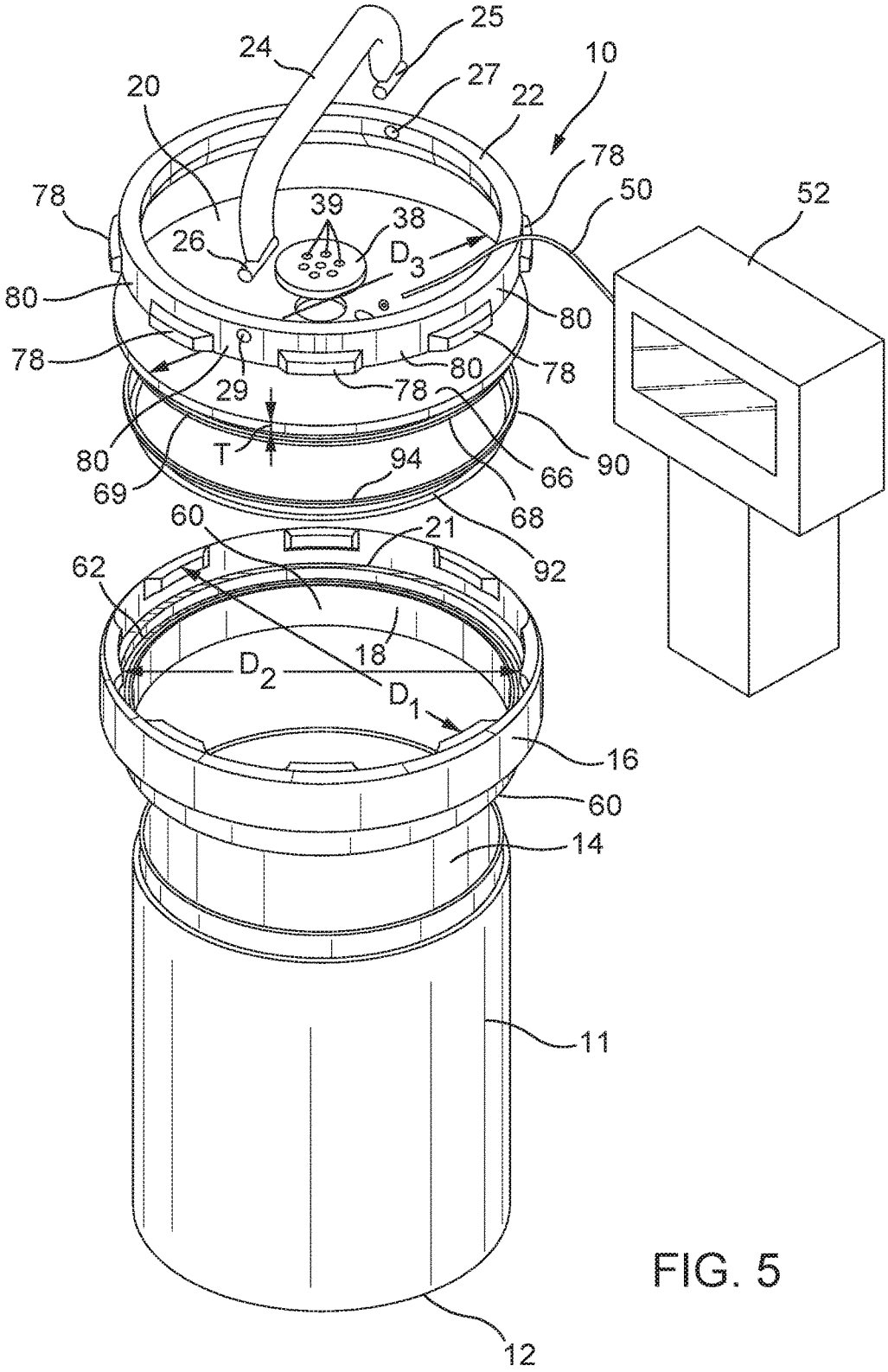
FIG. 5 is an exploded view, in perspective, of one of the storage containers as shown in FIGS. 1-4.

Referring now to FIG. 5 where various components of the container 10 are shown separated, the rim 16 is configured to be joined to the open end 14 of the can 11 by welding a collar portion 60 to the can 10. The collar portion 60 may abut the open end 14 of the can 10, may fit over the outside surface of the can, or may be received within the inside surface of the can. Positioning the open end 14 of the can 10 within the rim 60 is the preferable approach.

The inner wall surface 18 of the rim 16 has an annular shelf 62 which is abutted by the lid 20. The lid 20 has an outwardly facing surface 66 and an inwardly facing surface 68 and has a diameter D3 which is less than the diameter D1 at the opening of the rim 16, but greater than the diameter D2 of the shelf 62. Consequently, the lid 20 passes through the open end of the rim 16 and rests on the shelf 62.

Figure 6:
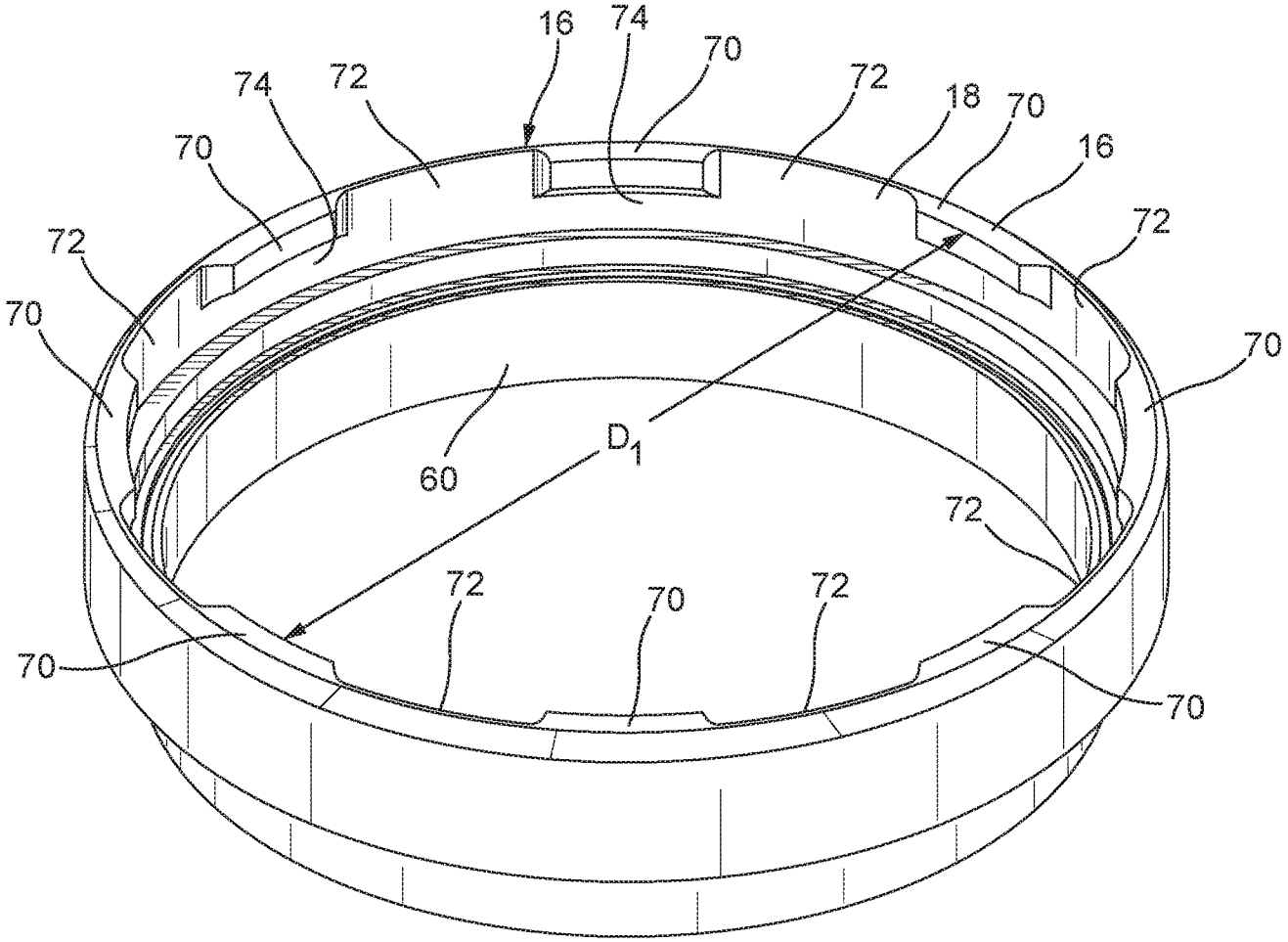
FIG. 6 is a perspective view of a rim used with the storage containers of FIGS. 1-5.

Referring now to FIG. 6, the diameter D1 at the opening of the rim 16 is defined between lugs 70 disposed adjacent the opening of the rim 16, which lugs 70 have spaces 72 therebetween. The lugs 70 are axially spaced from the shelf to by spaces 74 which are greater than the thickness T of the lid 20.

Figure 7:
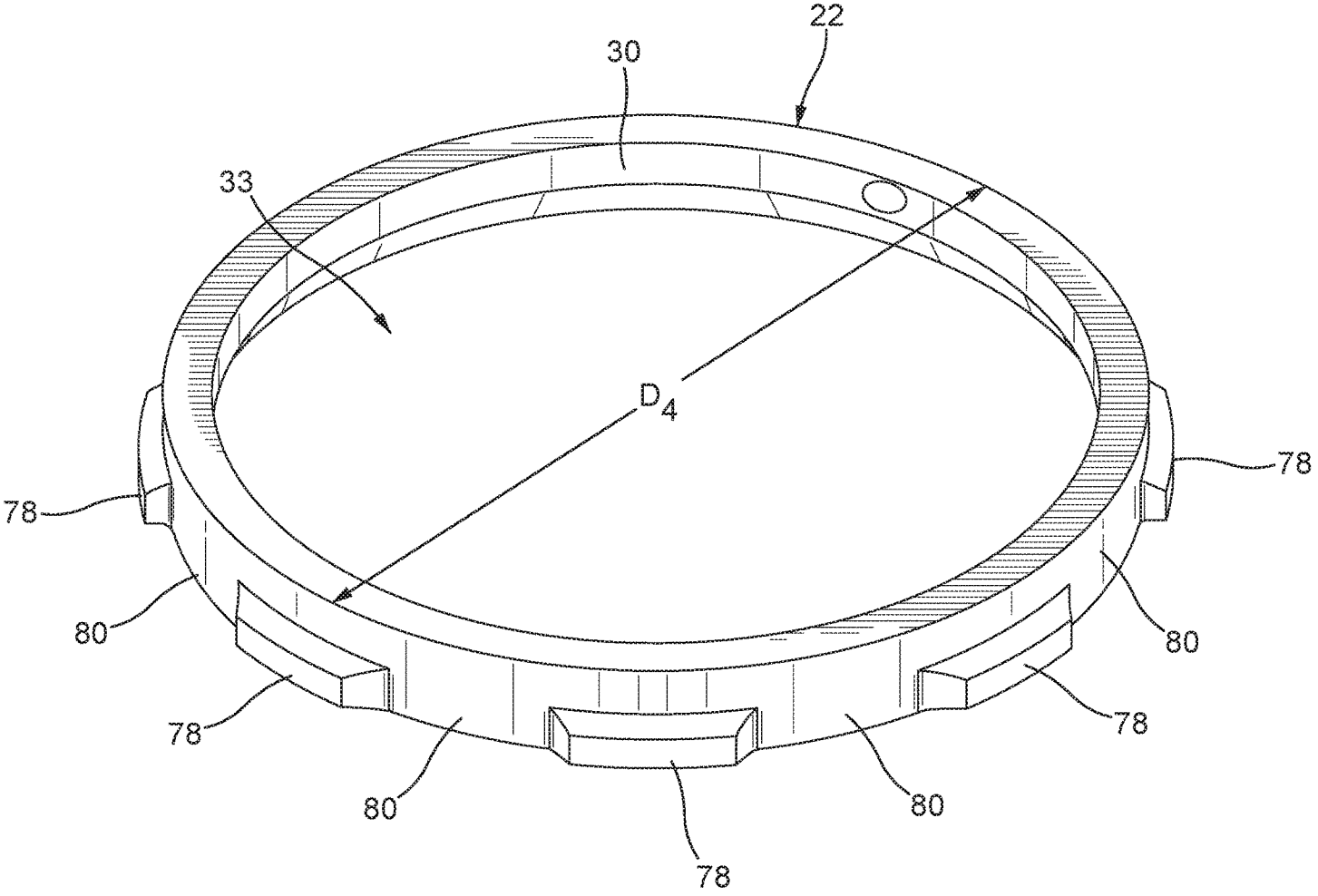
FIG. 7 is a perspective view of a retaining ring which cooperates with the rim of FIG. 6.

Referring now to FIG. 7, the retaining ring 22 has an outer diameter D4 which is less than the inner diameter D1 of the rim 16 so that it slides in an axial direction into the cavity 33 formed by the rim and abuts the lid 20. The retaining ring 22 has second lugs 78 which project radially outwardly therefrom and are spaced from one another by circumferential spaces 80. The circumferential spaces 80 have an arcuate length greater than the length of the spaces 72 in the rim 16 and are disposed adjacent the bottom of the retaining ring. Moreover, the second lugs 78 of the retaining ring 22 have a height such that the height of the second lugs and the thickness of the lid 20 allows the retaining ring to be rotated so that the second lugs 78 thereon fit beneath the first lugs 70 on the rim 16 providing a bayonet coupling to hold the lid 20 in place on the can 11. As is apparent from FIG. 1, in addition to providing a convenient way to lift the container 10, the handle 24 by having pintles 25 and 26 received in holes 27 and 28 also provides a device for rotating the retaining ring 22 to position the second lugs 78 beneath the first lugs 70.

Figure 8:
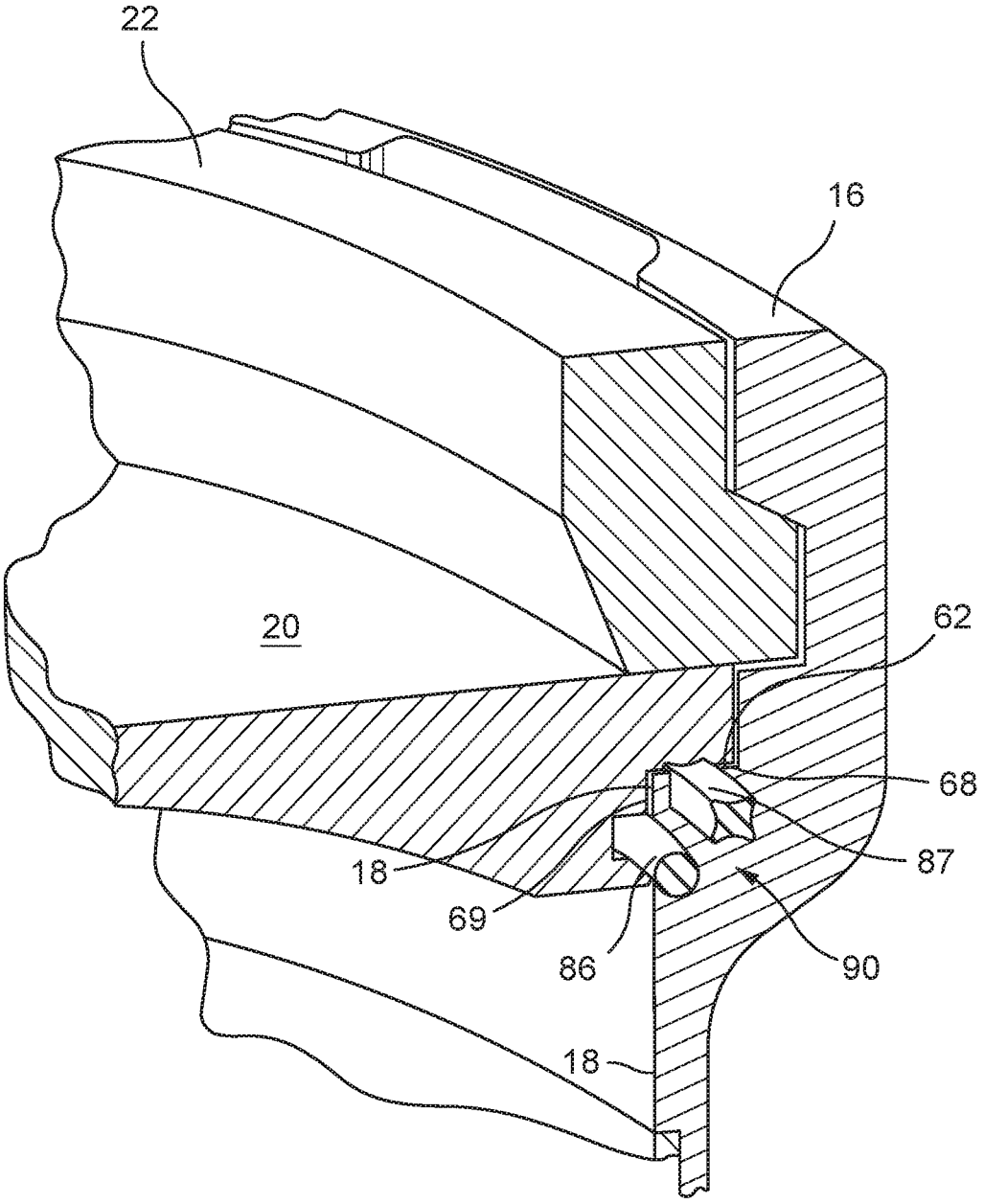
FIG. 8 is a perspective elevation of a seal shown in FIG. 5.

Referring now mainly to FIG. 8, disposed between the lid 20 and the shelf 62 of the rim 16 is a sealing arrangement 85 which is disposed between a bottom surface 68 of the lid and the shelf 62. The sealing arrangement 85 may comprise a single seal such as an O-ring 86 of a circular cross section, but it is preferable that the sealing arrangement 85 be comprised of the radial O-ring 86 of a circular cross section and a cruciform shaped, multi-lobed compression O-ring 87. The radial O-ring 86 seats between the periphery 69 of the lid 20 and the wall 18 of the rim 16, while the compression O-ring 87 is compressed between the inside surface 68 of the lid and the shelf 62. The O-ring arrangement 85 provides a positive seal which is maintained during impacts from different and opposing directions. Engagement between the sealing arrangement 85, rim 16 and the lid 20 results in a leak resistant closure mechanism having leak rate of about $1\times10^{-8}$ cc/per second. The seals 86 and 87 are preferably made of a fluoroelastomer material such as VITON® rubber having a sealing life of at least 20 years.

The container 10 is configured so that there is a 100% interchangeability of the lids 20 for containers of the same size which enhances speed and the assurance of a seal. The sealing is visibly verified when the lugs 78 disappear beneath the lugs 70. By providing drains, such as the drains 42 (see FIG. 9) which communicate with the space 33, liquid which may accidentally accumulate on the lid 20 by situations such as an inadvertent activation of a fire suppressant system, water is kept from accumulating on the lid 20. This also minimizes any contamination of a container should radioactive material become spilled, or otherwise deposited, on the exterior of the container. Since the containers 10 utilize stainless steel with high heat conductivity, heat will be dissipated should heat develop within the container.

Moreover, the container can withstand external and internal temperatures in excess of 450° F.

Figure 9:
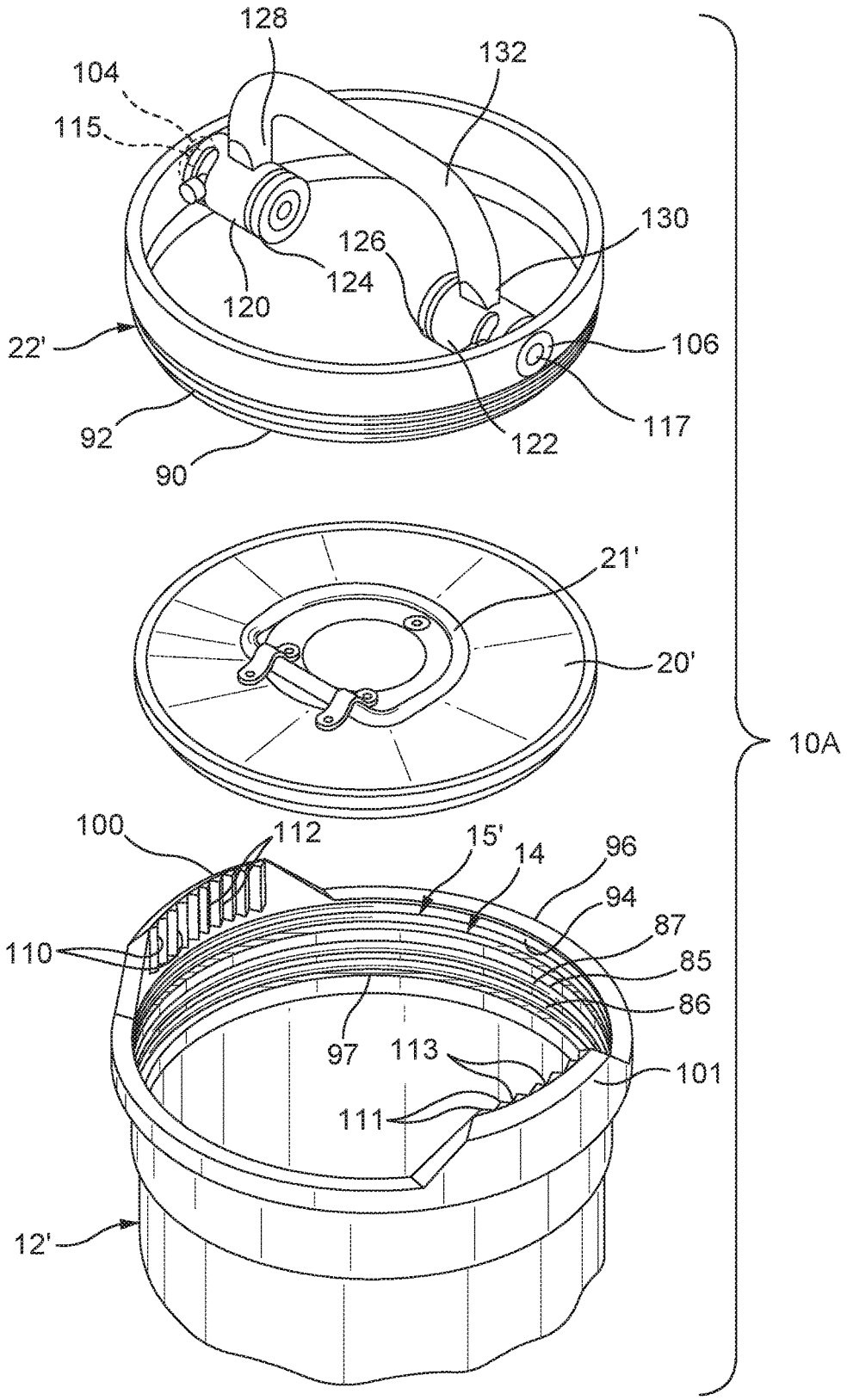
FIG. 9 provide is a perspective exploded view of a second embodiment of the storage container, which is similar to the first embodiment, but utilizes a locking ring.

Referring now to FIG. 9, where a second embodiment 10A of the container 10 is illustrated, the retaining ring 22 has a threaded portion 90 with an external quad-lead thread 92. The external quad-lead thread 92 meshes with the internal quad-lead thread 94 on a locking rim 96 defining a mouth 15' of the container 10*a*. As the retaining ring 22' is advanced downwardly by screwing the retaining ring into the quad-lead threads 94, the compression lid 20 is urged down between the radial O-ring 86 and the wall 97 of the rim 96.

In the embodiment 10A, the container of FIGS. 9, the bayonet coupling 23 of FIGS. 1-8 is replaced by first ratchet couplings 100 and 102 101 on the rim 102 deposed at the open end 14' of the container 10A and second ratchet couplings 104 and 106 disposed on the retaining ring 22'. The first ratchet couplings 100 and 101 are opposed segments of a circle with teeth 110 and 111 that have ramped ridges defining valleys 112 and 113 therebetween. The valleys 112 and 113 receive detents 115 and 117 that project radially from the retaining ring 22'. The detents are preferably spring projected, ball detents 115 and 117 mounted in hubs 120 and 122 of hinges 124 and 126 which rotatably support opposed ends 128 and 130 of a U-shaped handle 132. The hubs 120 and 124 have actuators 134 and 136 which allow the ball detents 115 and 117 to retract into the hubs so that the retaining ring 22' can be rotated to allow removal of the compressing lid 20' using the lifting handle 21 thereon.

Figure 10A:
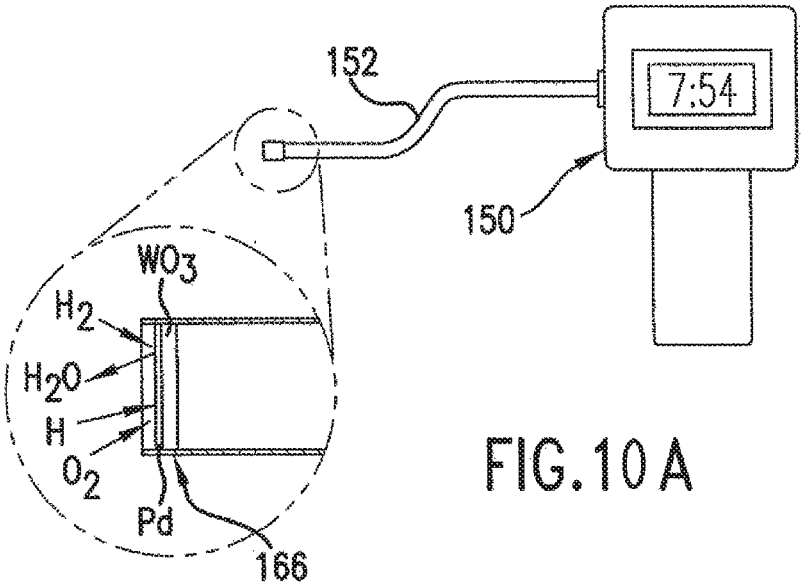
FIG. 10A is a side view of a fiber optic probe-arrangement of a type preferably used with the containers of FIGS. 1-10.
Figure 10B:
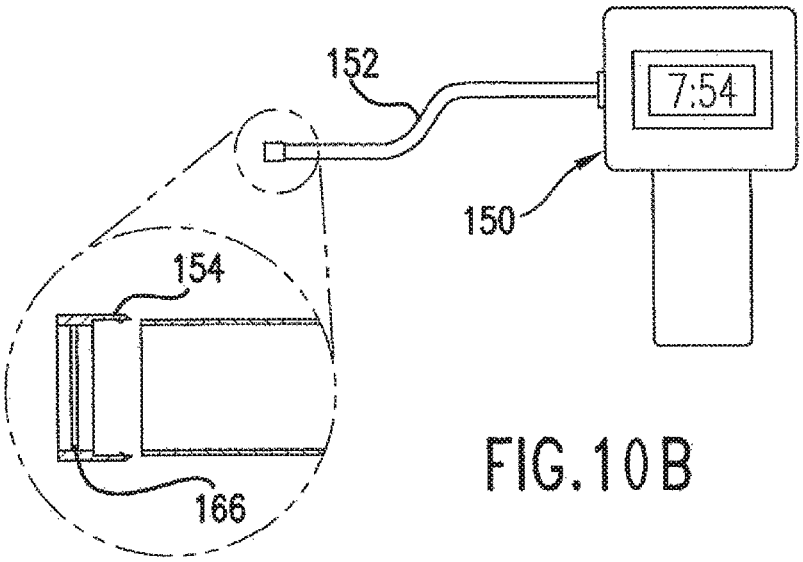
FIG. 10B is a view similar to FIG. 10A but showing a snap on detector head.
Figure 10C:
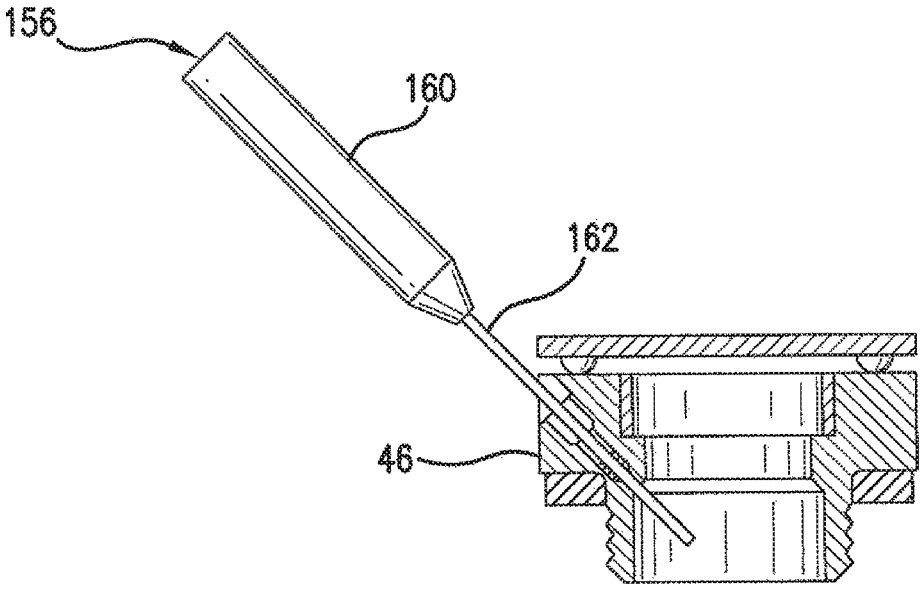
FIG. 10C is a perspective view of a needle probe being inserted through a one way valve in a needle port.
Figure 11:
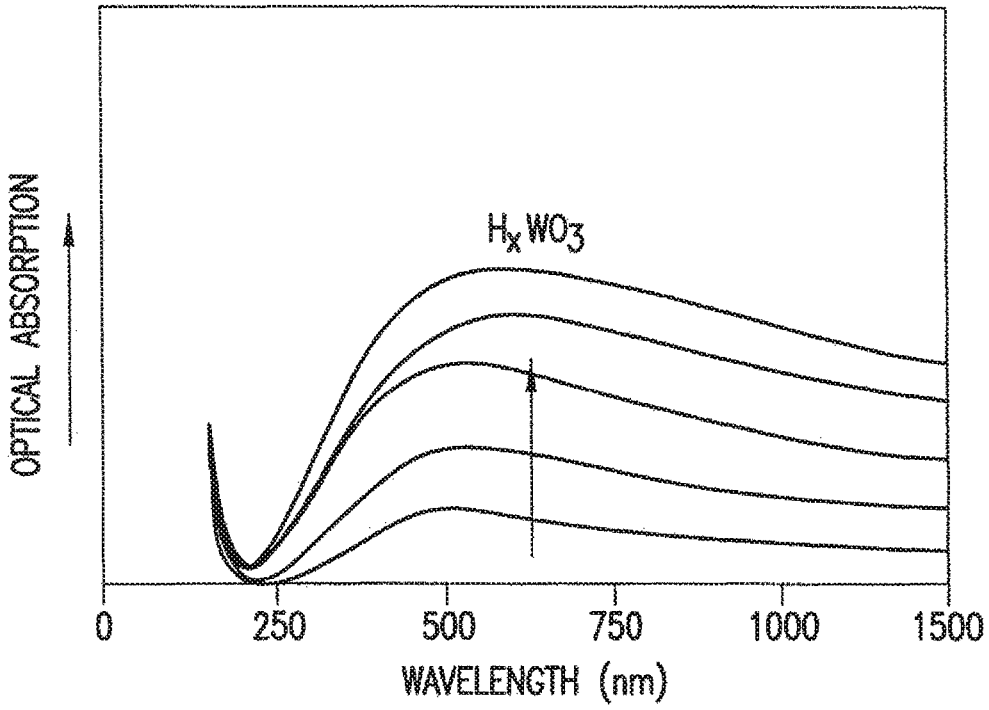
FIG. 11 is a view of a graph plotting wavelength (nm) as a function of optical absorption for the sensing tip of the fiber optic cable of FIG. 10A, 10B, AND 10C.

Referring now to FIGS. 10A, 10B, 10C and 11, an embodiment of a hydrogen gas detector 150 is shown. The hydrogen gas detector 150 has a fiber optic lead 152 that preferably has a snap-on detector head 154 (FIG. 10A). The snap-on detector head 154 is receivable in an opening 156 in the end of a needle probe 160 (FIG. 10C) having a needle shank 162 that penetrates the one-way valve 46 for sampling gas in the containers 10 and 10*a*. The one-way valve 46 in this instance is a hermetic seal, such as the seal used in U.S. Pat. No. 6,395,050, issued May 28, 2002, assigned to the assignee of the present invention, Nuclear Filter Technology and incorporated herein in its entirety by reference, through which seal 46 the shank 162 of the needle passes. In the present invention the seal 46 is preferably integral with the lid 20 as is shown in FIGS. 1, 4 and 5. However, the seal 46 may be incorporated in a vent structure for the housing or in a separate plug structure. The amount of hydrogen detected alters optical absorption through a tungsten tri-oxide glass layer 166 according to the graph of FIG. 11 plotting optical absorption as a function of the wavelength of light reflected from the tungsten tri-oxide layer 166.

From the foregoing description, one skilled in the art can easily ascertain the essential characteristics of this invention, and without departing form the spirit and scope thereof, can make various changes and modifications of the invention to adapt it to various usages and conditions.

The following text is a compliance report created as a result of the performance tests performed on a New Generation Standard Nuclear Material Container consistent with the invention herein. The standard for success in the performance test conducted on the Tested Device was defined by the requirements of Department of Energy Manual § 441, Nuclear Material Packaging Manual, DOE M 441.1-1 approved Mar. 7, 2008, certified Nov. 18, 2010. The Tested Device met or exceeded the requirements of the performance test.

We claim:

1. A method comprising placing hazardous material inside a container and sealing said container;

wherein said container is comprised of a material suitable for containing hazardous materials, wherein when said container is filled with helium and dropped from a height of 12 feet onto an unyielding surface, the leak rate does not exceed 8.4 E-05 Atm-cc/sec-, and wherein said container comprises:

a closed end and an open end;

a locking rim located at the open end of the can, the locking rim having a shelf therein of a first inner diameter and having first locking members thereon disposed in spaced relation to the shelf;

a lid separate from the locking rim having an outer surface and an inner surface, the lid having an outer diameter larger than the inner diameter of the shelf in the locking rim wherein when the lid is mounted on the can, the lid is within the locking rim and supported on the shelf;

at least one gasket between the shelf and the lid;

a retaining ring mounted for initial rotation with respect to the locking rim for locking the lid to the locking rim upon rotating the retaining ring with respect to the locking rim, the retaining ring being separate from the lid and having second locking members thereon alignable with the first locking members on the locking rim to secure the retaining ring to the locking rim and thereby positively hold the lid against the shelf and on the can.

2. The method of claim 1 wherein the container includes a handle mounted on the retaining ring.

3. The method of claim 2 wherein the container has a cavity defined above the lid by the retaining ring and wherein the handle is U-shaped and is pivoted to the retaining ring by pintles which extend into holes in the retaining ring to dispose the handle within the cavity when the handle is folded toward the lid.

4. The method of claim 1 wherein the retaining ring of the container has laterally opening drains extending therethrough to drain liquid from the lid.

5. The method of claim 1 wherein the container is made of stainless steel which has high heat conductivity and withstands temperatures to about 450° F.

6. The method of claim 1 wherein the hazardous waste in the container includes transuranic material.

7. The method of claim 1 wherein the container includes a gas vent therethrough, the gas vent having a particle filter therein.

8. The method of claim 7 wherein the filter is a HEPTA filter which excludes passage of liquids but allows passage of gas and vapor.

9. The method of claim 8 wherein the container further includes a sampling port containing a valve allowing insertion of a probe through the port to sample fluid within the container.

10. The method of claim 9 wherein both the vent and sampling port are through the lid.

11. The method of claim 1 wherein the container is used in combination with a second container of differing height, width and volume, and wherein said container is stored within the second container.

12. The method of claim 1 wherein the first and second locking members of the container are first and second spaced lugs, respectively, wherein when the first and second lugs are misaligned while the lid is in engagement with the gasket on the shelf, the lid is not locked to the shelf and wherein when the lid is rotated to align the first and second lugs, the second lugs fit beneath the first lugs forming a bayonet connection locking the retaining ring to a locking lid and positively holding the lid on the can.

13. The method of claim 12 wherein the container includes a radial gasket engaging the rim peripherally and a compression gasket engaging the tub in an axial direction.

14. The method of claim 13 wherein the radial gasket of the container is an O-ring and wherein the compression gasket has a cruciform cross section.

15. The method of claim 1 wherein the lid of the container has a peripheral thread and the open end of the can has an internal thread which complements the peripheral thread of the lid, the lid having at least one biased projection thereon aligned with ratchet teeth adjacent the open end of the can for establishing a ratchet connection between the lid and the can wherein as the lid is rotated to tighten the lid against the gasket.

16. The method of claim 15 wherein a radial gasket engages the locking rim of the container peripherally and a compression gasket engages the locking rim of the container in an axial direction.

17. The method of claim 16 wherein the radial gasket is an O-ring and wherein the compression gasket has a cruciform cross section.

18. A container comprising:

a material suitable for containing transuranic materials and further comprising a can having a closed end and an open end;

a locking rim located at the open end of the can, the locking rim having a shelf therein of a first inner diameter and having first locking members thereon disposed in spaced relation to the shelf;

a lid separate from the locking rim having an outer surface and an inner surface, the lid having an outer diameter larger than the inner diameter of the shelf in the locking rim wherein when the lid is mounted on the can, the lid is within the locking rim and supported on the shelf;

at least one gasket between the shelf and the lid;

a retaining ring mounted for initial rotation with respect to the locking rim for locking the lid to the locking rim upon rotating the retaining ring with respect to the locking rim, the retaining ring being separate from the lid and having second locking members thereon alignable with the first locking members on the locking rim to secure the retaining ring to the locking rim and thereby positively hold the lid against the shelf and on the can; and wherein when said container is filled with helium and dropped from a height of 12 feet onto an unyielding surface, the leak rate does not exceed 8.4 E-05 Atm-cc/sec.

19. The container of claim 18 wherein a handle is mounted on the retaining ring.

20. The container of claim 18 wherein a cavity is defined above the lid by the retaining ring and wherein the handle is U-shaped and is pivoted to the retaining ring by pintles which extend into holes in the retaining ring to dispose the handle within the cavity when the handle is folded toward the lid.

21. The container of claim 18 wherein the retaining ring has laterally opening drains extending therethrough to drain liquid from the lid.

22. The container of claim 18 wherein the container is made of stainless steel which has high heat conductivity and withstands temperatures to about 450° F.

23. The container of claim 18 wherein container comprises material suitable to contain plutonium in the form of oxides and salts.

24. The container of claim 23 wherein the container includes a gas vent therethrough, the gas vent having a particle filter therein.

25. The container of claim 24 wherein the filter is a HEPTA filter which excludes passage of liquids but allows passage of gas and vapor.

26. The container of claim 25 further including a sampling port containing a valve allowing insertion of a probe through the port to sample fluid within the container.

27. The container of claim 26 wherein both the vent and sampling port are through the lid.

28. The container of claim 18 in combination with similar containers of differing heights, widths and volumes, wherein the container is receivable within another container and can receive another container therein to nest a series of similar containers.

29. The container of claim 18 wherein the first and second locking members are first and second spaced lugs, respectively, wherein when the first and second lugs are misaligned while the lid is in engagement with the gasket on the shelf, the lid is not locked to the shelf and wherein when the lid is rotated to align the first and second lugs, the second lugs fit beneath the first lugs forming a bayonet connection locking the retaining ring to a locking lid and positively holding the lid on the can.

30. The container of claim 29 wherein there is a radial gasket engaging the locking rim peripherally and a compression gasket engaging the locking rim in an axial direction.

31. The container of claim 30 wherein the radial gasket is an O-ring and wherein the compression gasket has a cruciform cross section.

32. The container of claim 18 is made of stainless steel.

* * * * *